US005997277A

United States Patent [19]

Heed et al.

[11] Patent Number: 5,997,277

[45] Date of Patent: Dec. 7, 1999

[54] METHOD AND A DEVICE FOR RECOVERY OF ENERGY FROM MEDIA CONTAINING COMBUSTIBLE SUBSTANCES EVEN AT LOW CONCENTRATION

[75] Inventors: Björn Heed; Åke Källstrand, both of Göteborg, Sweden

[73] Assignee: Megtec Systems AB, Sweden

[21] Appl. No.: 09/077,246

[22] PCT Filed: Dec. 8, 1995

[86] PCT No.: PCT/SE95/01476

§ 371 Date: May 19, 1998

§ 102(e) Date: May 19, 1998

[87] PCT Pub. No.: WO97/21959

PCT Pub. Date: Jun. 19, 1997

[51] Int. Cl.[6] ..... F23D 11/44; F23L 15/02; F23L 1/00; F16K 11/00; C08J 5/17

[52] U.S. Cl. ..... 431/11; 431/5; 431/7; 431/170; 165/4; 137/309; 137/311; 110/147; 110/163; 110/211; 432/250

[58] Field of Search ..... 431/5, 7, 11, 326, 431/170; 122/4 D; 165/4; 137/309, 311; 110/211, 295, 296, 208, 204, 147, 148, 158, 163, 244, 309, 310, 297, 348, 349; 432/250

[56] References Cited

U.S. PATENT DOCUMENTS

| | | | |
|---|---|---|---|
| 4,085,593 | 4/1978 | Larsen | 122/4 D |
| 4,116,005 | 9/1978 | Willyoung | 122/4 D |
| 4,741,690 | 5/1988 | Head | 431/7 |
| 4,779,574 | 10/1988 | Nilsson et al. | 122/4 D |
| 4,811,696 | 3/1989 | Lacquement et al. | 122/4 D |
| 5,186,901 | 2/1993 | Bayer et al. | 431/170 |
| 5,236,354 | 8/1993 | Goldbach et al. | 431/5 |

FOREIGN PATENT DOCUMENTS

| | | |
|---|---|---|
| 0127746 | 4/1984 | European Pat. Off. . |
| 0440181 | 1/1991 | European Pat. Off. . |
| 9004742 | 5/1990 | WIPO . |
| 9312382 | 8/1992 | WIPO . |

*Primary Examiner*—Ira S. Lazarus
*Assistant Examiner*—David Lee
*Attorney, Agent, or Firm*—Mitchell D. Bittman; Kevin Lemack

[57] ABSTRACT

This invention relates to a method and device for recovery of energy from a medium containing combustible substances even at low concentrations. The method is characterized by raising the temperature of the medium in a regenerative combustor such as a reversal flow direction combustion device wherein the combustion takes place in a warm zone, to the combustion temperature at which essentially all chemical energy of the combustible substances is transformed into thermal energy. The heated medium is then utilized for the production of a wanted form of energy.

13 Claims, 2 Drawing Sheets

METHOD AND A DEVICE FOR RECOVERY OF ENERGY FROM MEDIA CONTAINING COMBUSTIBLE SUBSTANCES EVEN AT LOW CONCENTRATION

BACKGROUND OF THE INVENTION

The subject invention relates generally to a method and a device for recovery of energy from media containing combustible substances even at low-concentrations, and more particularly to energy recovery in connection with the purification of said media by combustion of the combustible substances.

It is already known to purify exhaust fumes emanating for instance from painting and printing works and containing combustible substances, such as solvents, by heating the fumes up to the temperature of combustion of the combustible substances. However, this is an expensive process on account of the need to heat the entire flow of the exhaust medium. Owing to a "combustion exchanger", one embodiment of which is described for instance in connection with an absorption technique in the Swedish Patent Specification 8903556-2, it is possible to reduce the costs associated with heating the exhaust fumes. In said Patent Specification the combustion exchanger is defined as an apparatus comprising a heat-accumulating bed which may be heated up to the spontaneous combustion temperature of the combustible substances and in which bed the combustible substances, by reversing their direction of flow, attribute to sustaining the spontaneous combustion temperature inside the bed. An apparatus of this type is described also in e.g. U.S. Pat. No. 4,741,690. When certain amounts of the combustible substances are present in the medium the heating of the medium inside the combustion exchanger may take place by the energy released from the spontaneous combustion of the substances inside the bed. Supplementary heating thus becomes necessary only to heat the bed to the spontaneous combustion temperature when the plant is being started up or when the quantity of combustible substances is very small and insufficient to independently sustain the spontaneous combustion temperature inside the bed.

Owing to the high efficiency of the combustion exchanger it is, however, comparatively rare that the amount of combustible substances in the medium is insufficient, as in the latter case mentioned above. Thus, the amount of combustible substances usually is in excess of the amount required to sustain the spontaneous combustion temperature inside the bed. This leads to an increase of the heat in the bed, which in turn results in an increased demand for cooling of the bed in order to avoid damages thereto and to the surrounding area. In addition, the fact that the thermal energy developed in the combustion is not recovered is a problem as such, considering the high energy costs and environmental aspects.

SUMMARY OF THE INVENTION

One purpose of the subject invention therefore is to provide a method and an apparatus allowing the surplus of thermal energy generated in the combustion in a regenerative combustor, i.e. a reversal flow direction combustion device wherein the combustion takes place in a warm zone, which preferably is a combustion exchanger, to be made use of.

Another purpose of the method and the apparatus according to the invention is to provide not only energy recovery but jointly therewith control of the temperature in the regenerative combustor.

Another purpose of the method and the apparatus according to the invention is to eliminate toxic or climate-endagering or malodorous substances by burning them.

Yet another purpose of the invention is to recover, from the regenerative combustor, thermal energy of such a quality that it may be used primarily for high temperature output, for instance in the production of electricity.

These and other purposes are achieved in accordance with the invention by means of a method and an apparatus defined in the characterizing clauses of the appended claims.

One embodiment of the subject invention will be described in closer detail in the following with reference to the accompanying drawings, wherein:

DETAILED DESCRIPTION OF THE INVENTION

Figure 1:
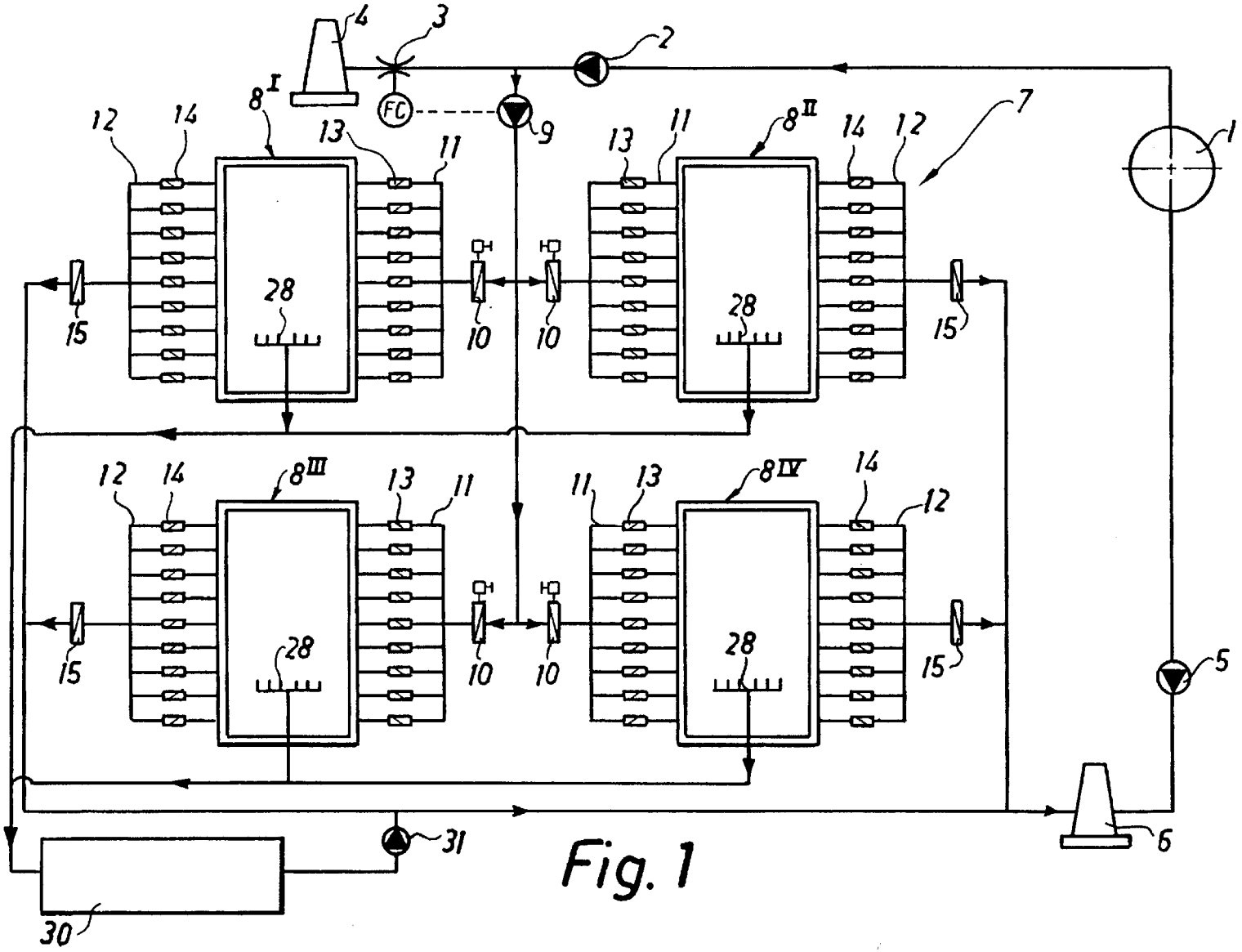
FIG. 1 schematically in a view from above illustrates an apparatus in accordance with the invention for purification of exhaust or ventilation air from a coal mine.

The apparatus illustrated in FIG. 1 is used to purify a medium, in the subject case the exhaust or ventilation air from a coal mine. Exhaust air of this kind usually contains combustible substances, i.a. combustible methane gas. Exhaust air is carried from a mine shaft 1 via a fan 2 and a valve 3 to a stack 4, or, via a fan 5 to a stack 6 when the inventive apparatus, generally designated by reference 7, is not used.

In accordance with the embodiment illustrated the device 7 according to the invention comprises four combustion exchangers, the exchangers being designated generally by references 8, $\mathbf{8}^{I}$, $\mathbf{8}^{II}$, $\mathbf{8}^{III}$, $\mathbf{8}^{IV}$, but it could of course include a larger or smaller number of combustion exchangers, depending on the field of usage. Via a process fan 9, which is common to all the combustion exchangers, and a valve 10, one for each combustion exchanger, each combustion exchanger 8 is connected to a plurality of inlet ducts 11 and a plurality of outlet ducts 12. In accordance with the embodiment shown there are nine inlet ducts and nine outlet ducts but the number of inlet and outlet ducts could be varied. Each inlet duct 11 and each outlet duct 12 is equipped with a damping device, generally designated by references 13 and 14, respectively. By way of a valve 15, one for each combustion exchanger 8, the outlet ducts 12 lead to the stack 6. The single fan 9 can also be replaced by e.g. four fans, one each for each combustion exchanger.

Figure 2:
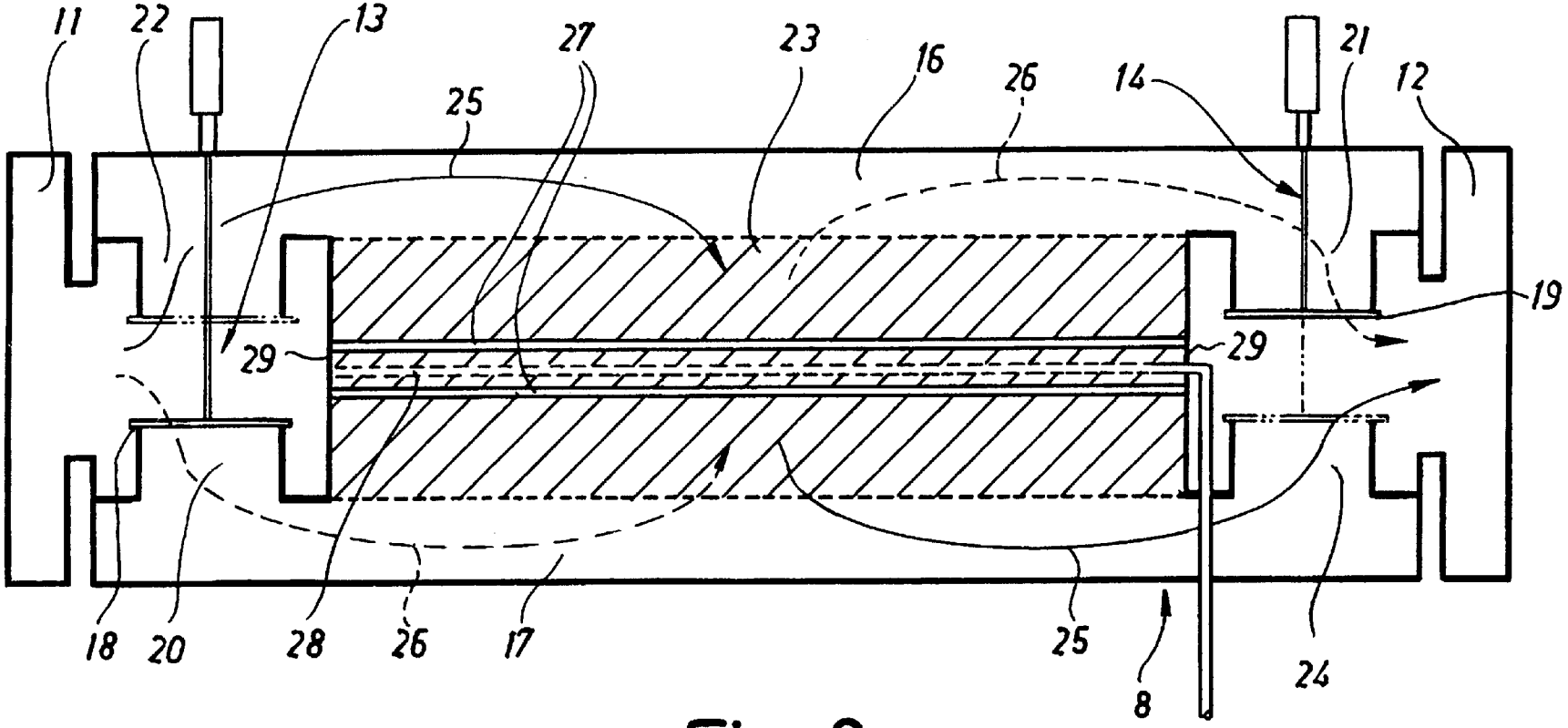
FIG. 2 is a schematical lateral view of a combustion exchanger according to the invention.

FIG. 2 is a schematical cross-sectional view through a combustion exchanger 8. The damping devices 13 and 14 are formed with dampers 18 and 19, respectively, which are movable vertically between two sealing positions in which each damper sealingly abuts against its channels 16 and 17, respectively. The two dampers 18 and 19 never seal off the same channel and in the position illustrated in continuous lines the damper 18 seals off the entrance 20 to channel 17 whereas the damper 19 seals off the exit 21 from channel 16. Consequently, the medium containing combustible substances is carried via the inlet duct 11 through the entrance 22 of channel 16 into the bed 23 of the combustion exchanger wherein the substances are burnt in a manner known per se, whereupon the flow continues out through channel 17 and through its exit 24 to the outlet duct 12. This flow is illustrated schematically by continuous arrows 25 in FIG. 2. In a manner known per se the flow direction through the bed 23 of the combustion exchanger should be reversed from time to time to avoid that the heat front of the bed 23 moves too close to one of the channels 16, 17. Upon such reversal, the dampers 18 and 19 are moved to the positions illustrated in FIG. 2 in discontinuous lines and the flow associated with these damper positions is illustrated schematically by means of the dotted-line arrows 26.

Obviously, the valves 10, 15 may be used to stop the flow to and from a combustion exchanger, for instances during servicing, for repairs and the like. It is further understood that valve 3 could be a valve which, depending on the flow through the fan 9, opens or closes the flow to the stack 4 in order to ensure that the shaft 1 is always ventilated, independently of the flow through the device 7.

In the area of the centre of the bed 23, the area known as the combustion zone, there is a heating device 27, which could be electrically heated, with the aid of which the bed could be heated to the spontaneous combustion temperature of the combustible substances, for instance when the combustion exchanger is to be started up.

In the area of the combustion zone there is also a drain or diverting means 28 which is used to divert a part flow of the heated medium after combustion. In accordance with this embodiment, the diverting means 28 is a perforated tube extending along the bed 23 of the combustion zone but could also be configured differently, for instance as a means arranged to suck medium directly through the wall 29 of the bed 23. In accordance with the illustrated embodiment the diverting means 28 is in turn connected to a steam boiler 30, illustrated schematically in FIG. 1. Medium diverted by the diverting means 28 is carried through the steam boiler 30 to the stack 6 via a fan 31 which compensates for the pressure drop inside the boiler.

Because the spontaneous combustion temperature in the combustion exchanger is approximately 1000° C. in accordance with the embodiment described, according to which the combustible substance preferably consists of methane gas emanating from a coal mine, medium diverted directly from the combustion zone may be efficiently made use of in the steam boiler 30 to generate electric energy by using a steam turbine and a generator. This electric energy could be used in accordance with the embodiment above for instance to operate one fan or several fans 2, 5, 9 and 31. Because in mining it is absolutely necessary that the galleries are ventilated at all times on account of the risks of explosion, it is essential that at least one of the fans 2, 5 permenantly is in function, i.e. also in the case of failure of the electricity mains. Otherwise, the mine has to be evacuated, which is a difficult, time-consuming and costly operation. Owing to the invention such fans may be operated in a cost-efficient manner without the mine having to rely on supply of electricity from an external distribution network. In addition, surplus electric energy generated by the steam boiler, turbine and generator could be sold. The inventive device and method thus make it economically advantageous and technically possible to protect the environment by means of combustion inside the bed 23 and at the same time to produce electric energy.

In coal mines the methane gas concentration in the exhaust air normally amounts to maximum 20% L.E.L. (Low Explosion Limit). It has proved possible to construct the combustion exchanger in a manner allowing a thermal efficiency rate of 98% to be achieved. This means that a combustion exchanger is self-sufficient with respect to sustaining the spontaneous combustion temperature inside the combustion zone when the methane gas concentration in the medium exceeds 0.1% (2% L.E.L.). Application of the invention thus likewise makes it possible to recover electric energy also from media having a low concentration of combustible substances, which has hitherto not been practically possible. In addition, the amount of medium diverted by the diverting device 28 could be used to control the temperature inside the bed 23 in order to avoid that the combustion zone becomes too wide and for instance comes into contact with the bed-surrounding housing, which in itself could involve risks for burns and also unnecessary energy losses. With the inventive device it is also easy to control the diverted energy by varying the diverted flow in order to compensate for any variations in the amounts of combustible substance in the media moving through the bed 23. The combustion process is also very clean, since no prompt and/or thermal $NO_x$ is produced in a flame during the combustion.

It is understood that it is quite possible to modify the described embodiment somewhat. For instance, the number of combustion exchangers 8 as also the number of diverting means 28 in each bed 23 could be varied. The damping devices 13, 14 obviously could be configured differently as to details from those shown as long as they produce a change of flow direction inside the bed 23. In addition, the channels 16, 17 could be differently shaped and could for instance consist of perforated tubes arranged inside the bed 23, a combustion zone being established between them, for instance as described in the Swedish Patent Specification 9103634-3. It is also understood that instead of a combustion exchanger, any regenerative combustor could be used.

The heating medium could of course also be used to produce other forms of energy than electric energy and the diverting means 28 could in this case also be connected to other types of energy-production installations than a steam boiler 30. For instance, the heated medium could be used to heat another medium, such as water, in which case the thermal energy in said second medium is instead used for instance in a district heating system. Furthermore, the thermal energy of the heated medium could in this case be recovered by means of a diverting means in the form of at least one pipe which allows a corresponding flow of the second medium and which is disposed inside the combustion zone of a regenerative combustor, preferably the bed (23) of a combustion exchanger.

The device and method according to the invention are not either limited to use in mining operations but could also be used for instance in ventilation installations in the production of paints, in printing works, coating and lamination processes, the production of chemicals and pharmaceutical products, animal breeding installations, digestion plants, at waste deposits, and in the production of plastics and tyres, in other words in connection with such plants and processes wherein some kind of hydrocarbon compounds, such as solvents, styrene, plastic smokes, fumes from fuel tanks, fumes from fish-processing industries, diesel-engine or natural-gas soot, or combustible inorganic substances, i.e. carbon monoxide, e.g. from production of electric-furnace steel, or hydrogen, e.g. from chemical industries, are present in the medium to be transferred through the regenerative combustor, which preferably is a combustion exchanger. All kinds of combustible substances, i.e. also malodorous or toxic emanations from various processes or from degassifications or gas escapes can be efficiently eliminated from the medium whilst generating energy. It is also easily understood that the invention need not be used in combination with the stacks 4, 6, the fans 2, 5 or the valve 3 as illustrated in FIG. 1, but that it could instead be used in any installation wherein the medium meets with the above-mentioned requirements.

All such varieties and modifications that are encompassed by the basic inventive idea could however be regarded to be covered by the scope of protection of the appended claims.

We claim:

1. A regenerative combustor for combusting a gas containing combustible substances, comprising:

a combustion exchanger, said combustion exchanger comprising:

a housing for receiving said gas and having first and second channels, each said channel having an gas inlet and an gas outlet;

a first damper operative between a first position closing said first channel inlet and opening said second channel inlet, and a second position opening said first channel inlet and closing said second channel inlet;

a second damper operative between a first position closing said first channel outlet and opening said second channel outlet, and a second position opening said first channel outlet and closing said second channel outlet;

a combustion zone in said housing for combusting said gas containing combustible substances; said housing comprising diverting means for diverting at least a portion of said gas out of said housing prior to said gas exiting one of said channel gas outlets.

2. The regenerative combustor of claim 1, wherein said first and second dampers allow gas flow between said first channel and said second channel.

3. The regenerative combustor of claim 1, wherein said diverting means is positioned in said combustion zone.

4. The regenerative combustor of claim 1, wherein said diverting means comprises a perforated tube.

5. The regenerative combustor of claim 3, wherein said diverting means comprises a perforated tube.

6. The regenerative combustor of claim 1, wherein said diverting means diverts said portion of said gas to a steam boiler in fluid communication with said housing.

7. A method of recovering energy from a gas containing combustible substances, comprising:

feeding said gas into a regenerative combustor comprising:

a housing having first and second channels, each said channel having an gas inlet and an gas outlet; a first damper operative between a first position closing said first channel inlet and opening said second channel inlet, and a second position opening said first channel inlet and closing said second channel inlet; a second damper operative between a first position closing said first channel outlet and opening said second channel outlet, and a second position opening said first channel outlet and closing said second channel outlet; and a combustion zone in said housing for combusting combustible substances;

combusting said gas containing combustible substances in said combustion zone;

periodically altering the flow of said gas through said combustion zone by actuating said first and second dampers between their respective first and second positions; and diverting at least a portion of said gas in said housing out of said housing prior to said portion exiting one said gas outlets.

8. The method of claim 7, wherein said first and second dampers are actuated such that a gas flow path is created from said first channel inlet, through said combustion zone and out said second channel outlet.

9. The method of claim 7, wherein said first and second dampers are actuated such that a gas flow path is created from said second channel inlet, through said combustion zone and out said first channel outlet.

10. The method of claim 7, wherein said portion of said gas being diverted is diverted from said combustion zone in said housing.

11. The method of claim 7, wherein said portion of said gas being diverted is diverted by means of a perforated tube in said housing.

12. The method of claim 7, wherein said portion of said gas being diverted is diverted by means of a perforated tube in said combustion zone.

13. The method of claim 7, further comprising directing said diverted portion of said gas into a steam boiler in fluid communication with said housing.

* * * * *